United States Patent [19]

Auslender et al.

[11] 4,140,942

[45] Feb. 20, 1979

[54] RADIO-FREQUENCY ELECTRON ACCELERATOR

[75] Inventors: Vadim L. Auslender; Gersh I. Budker; Georgy B. Glagolev; Anatoly A. Livshits; Gennady N. Ostreiko; Alexandr D. Panfilov; Vladimir A. Polyakov, all of Novosibirsk, U.S.S.R.

[73] Assignee: Institut Yadernoi Fiziki Sibirskogo Otdelenia Akademii Nauk SSSR, Novosibirsk, U.S.S.R.

[21] Appl. No.: 811,264

[22] Filed: Jun. 29, 1977

[51] Int. Cl.[2] ..... H01J 25/10

[52] U.S. Cl. ..... 315/5.41; 315/5.15; 315/5.42

[58] Field of Search ..... 315/5.14, 5.15, 5.41, 315/5.42

[56] References Cited

U.S. PATENT DOCUMENTS

| | | | |
|---|---|---|---|
| 2,653,271 | 9/1953 | Woodyard | 315/5.42 |
| 2,802,965 | 8/1957 | Marner et al. | 315/5.42 X |
| 2,880,353 | 3/1959 | Warnecke et al. | 315/5.41 X |
| 2,883,536 | 4/1959 | Salisbury et al. | 315/5.41 X |
| 4,027,193 | 5/1977 | Schriber | 315/5.42 |

*Primary Examiner*—Saxfield Chatmon, Jr.
*Attorney, Agent, or Firm*—Lackenbach, Lilling & Siegel

[57] ABSTRACT

A radio-frequency electron accelerator included an accelerating resonator, an electron gun and a radio-frequency power source for transmitting radio-frequency energy to electron beam. The radio-frequency power source includes a self-excited oscillator built around a single oscillator tube mounted on the resonator. The cavity of the accelerating resonator accommodates a coupling loop directly connected to the anode of the tube and forming, in combination with the accelerating resonator, a two-circuit oscillation system in the anode circuit of the oscillator tube.

8 Claims, 5 Drawing Figures

RADIO-FREQUENCY ELECTRON ACCELERATOR

The invention relates to the accelerating technology, and more particularly to radio-frequency electron accelerators to be used in industry as powerful sources of ionizing radiation.

Direct-action electron accelerators comprising an accelerating tube and a high-voltage source providing a required energy of accelerated particles are very widely known in the art. The disadvantages of such arrangements include complicated manufacture of accelerating tubes, as well as problems associated with the provision of adequate electric strength of the tube. Where it is required to increase the electron energy up to the level of 1 MeV and higher, and to obtain greater output of the beam, the above problems become more complicated.

There are also widely known travelling-wave radio-frequency electron accelerators (lineacs). These accelerators comprise a number of series-connected accelerating resonators (corrugated waveguide), an electron gun, a radio-frequency power source which comprises an independent self-contained oscillator (e.g. magnetron), a system for transmission of radio-frequency power from the oscillator to the series-connected resonators (to the electron beam), a vacuum system, a matching load and a magnetic system for focusing the beam along the accelerator. In such accelerators, the problems associated with the electric strength are reduced since they do not use an accelerating tube.

However, in such accelerators the possibility of obtaining high output is restricted on the one hand by high power losses in the accelerating structure of the above type, and on the other hand, by excitation of parasitic oscillations in the resonators under the action of an intensive electron beam.

In addition, the provision of the self-contained oscillator which determines the oscillation frequency and output restricts the opportunities of controlling the accelerator current which influences high-frequency characteristics of the resonance accelerating structure and requires accurate maintenance of natural frequency of this structure which is generally made by using thermostatic control. The provision of matching load lowers the efficiency of the accelerator. The efficiency is also lowered due to the provision of the system for transmission of radio-frequency power from the oscillator to the resonance accelerating system. The use of a long accelerating system requires the provision of an additional magnetic focusing system to ensure the passage of the beam through the accelerator.

One object of the invention is to provide a radio-frequency electron accelerator which features the opportunity of providing high average outputs of electron beam.

Another object of the invention is to provide a radio-frequency accelerator featuring high electron efficiency.

Still another object of the invention is to simplify the construction and process of manufacture of radio-frequency electron accelerator.

The above objects are accomplished by a radio-frequency electron accelerator which includes an accelerating resonator accommodated in a metal vacuum casing, an electron gun feeding an electron beam axially along the resonator, and a radio-frequency power source for transmitting radio-frequency energy to the electron beam, according to the invention, the radio-frequency power source comprises a self-excited oscillator built around a single oscillator tube, and the cavity of the accelerating resonator accommodates a coupling loop having a separating capacitor directly connected to the anode of the tube and forming, in combination with the accelerating resonator, a two-circuit oscillation system in the anode circuit of the oscillator tube.

In order to suppress high-frequency resonance discharge and to evacuate ions from the accelerating gap, the accelerating resonator preferably comprises a pair of cup-shaped members partially received in each other with their open ends and electrically insulated from each other by providing a gap therebetween defining a capacitor for closing the path of high-frequency currents, a d.c. voltage being applied to one member.

D.c. voltage is preferably applied to the inner member of the resonator, and the edge of the outer member is electrically coupled to the metal vacuum casing along the entire perimeter.

Where the radio-frequency electron accelerator functions in the pulsed mode, the anode of the oscillator tube is preferably connected to an independent d.c. source for auxiliary excitation of the accelerating resonator during intervals between pulses.

The separating capacitor of the coupling loop may be made in the form of a system of plates having vacuum gaps therebetween.

The radio-frequency electron accelerator in accordance with the invention enables high average output of the beam of accelerated electrons. The combination of functions of self-excited oscillator and electron accelerator circuits permits a considerable improvement of electron efficiency of the accelerator, reduction of its size and simplification of the construction and process of manufacture.

The invention will now be described with reference to specific embodiments thereof illustrated in the accompanying drawings, in which.

Figure 1:
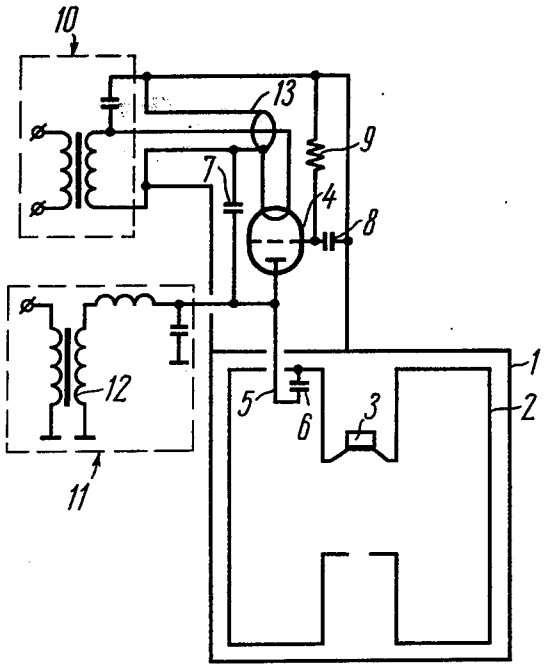
FIG. 1 shows a wiring diagram of the radio-frequency electron accelerator.

As shown in FIG. 1, the wiring diagram of the radio-frequency electron accelerator comprises a metal vacuum casing 1 accommodating a resonator 2 having centrally located internal projections on the end faces. Electrons injected by an electron gun 3 provided on one of the resonator projections are accelerated along the axis of revolution of the resonator 2. A source of radio-frequency power for transmitting radio-frequency energy to the electron beam comprises a self-excited oscillator built around a single oscillator tube 4 which is a powerful pulse-type oscillator triode connected in a common grid configuration. The oscillator tube 4 is mounted on the resonator 2. The cavity of the resonator 2 accommodates a coupling loop 5. A separating capacitor 6 in the coupling loop 5 is provided for separating the d.c. component of the anode voltage of the triode from the high-frequency component. The coupling loop 5 is directly connected to the anode of the oscillator tube 4 and forms in combination with the accelerating resonator 2, a two-circuit oscillation system in the anode circuit of the oscillator tube 4.

The self-excited oscillator uses an internal feedback formed by a capacitor 7 inserted between the cathode and anode of the oscillator tube 4. The grid of the oscillator tube 4 is grounded for high-frequency, via a capacitor 8, and the bias voltage is applied thereto by means of a bias resistor 9 inserted between the grid of the tube 4 and the casing of the oscillator. Heating of the oscillator tube 4 is effected from a heating voltage supply source 10. Anode voltage is fed from an anode supply source 11 which may include a pulse transformer 12 where the accelerator functions in the pulsed mode. Fine tuning of the feedback amplitude and phase is effected by using a cathode loop 13.

Figure 2:
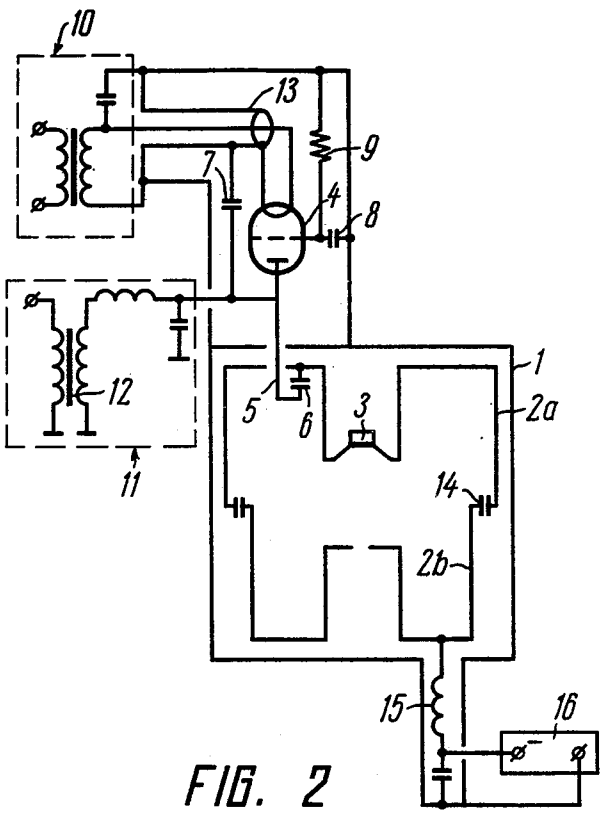
FIG. 2 shows a wiring diagram of the same accelerator incorporating a system for suppression of high-frequency resonance discharge and evacuation of ions from the accelerating gap.

In the embodiment of the radio-frequency electron accelerator shown in FIG. 2, the accelerating resonator is made of a pair of cup-shaped members 2*a* and 2*b*. In order to close the path of high-frequency currents, the members 2*a* and 2*b* are interconnected via a capacitor 14. The capacitor 14 may be made in the form of a large number of ceramic capacitors inserted in parallel between both members 2*a* and 2*b* of the resonator, but, in order to improve reliability of the accelerator, the capacitor 14 is preferably formed of the cup-shaped members 2*a* and 2*b* which are partially received in each other. Negative voltage from a supply source 16 is applied to one member 2*b* of the resonator via a choke 15.

Figure 3:
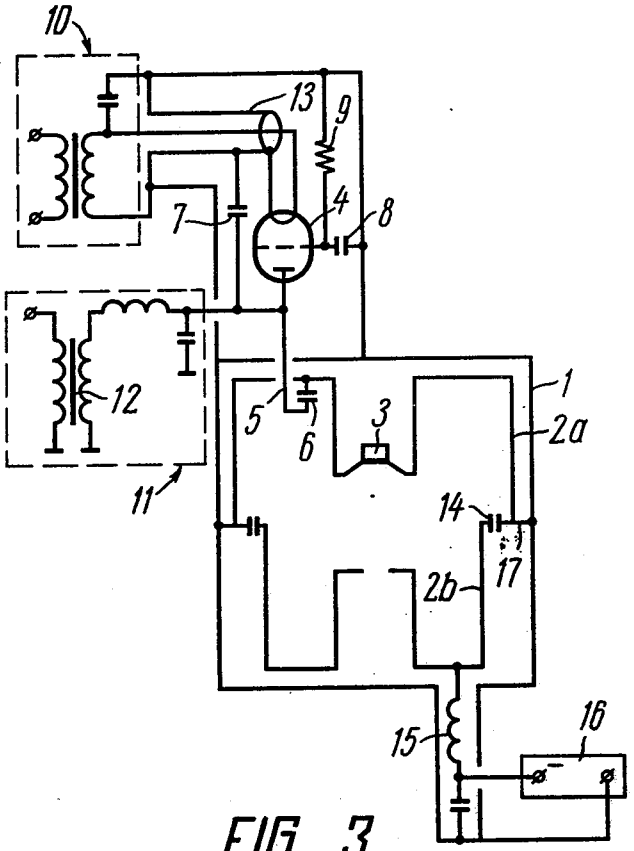
FIG. 3 shows a wiring diagram of the same accelerator having the edge of the outer member of the resonator electrically coupled to the metal vacuum casing along the entire perimeter.

In the embodiment of the radio-frequency electron accelerator shown in FIG. 3, as distinguished from the embodiment shown in FIG. 2, the edge 17 of the outer member 2*a* of the resonator is electrically coupled to the metal vacuum casing 1.

Figure 4:
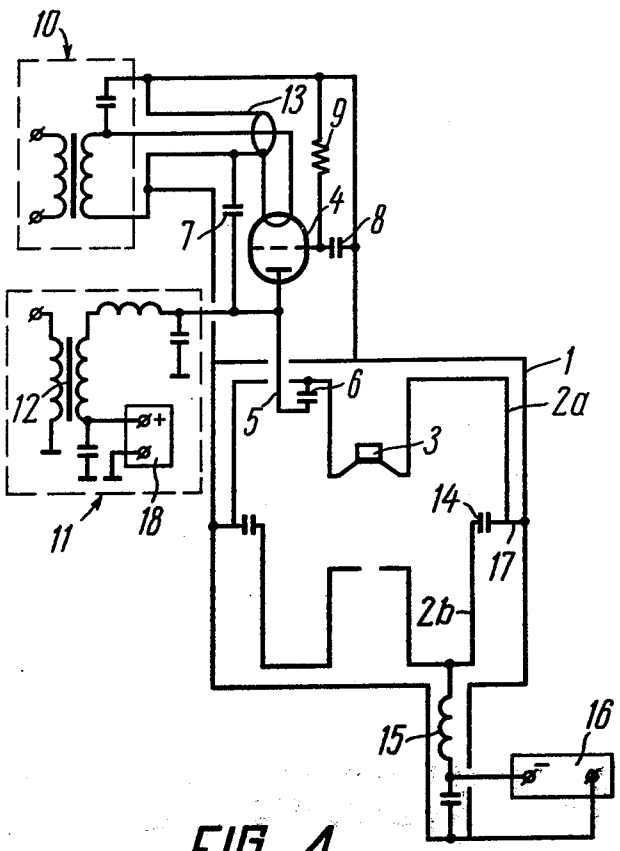
FIG. 4 shows a wiring diagram of the same accelerator having an independent d.c. source connected to the anode.

The embodiment of the radio-frequency accelerator shown in FIG. 4 differs in that it is designed for operation in the pulsed mode. An additional positive d.c. voltage source is connected to the anode of the oscillator tube 4. The source 18 is connected to the anode via a secondary winding of the pulse transformer 12.

Figure 5:
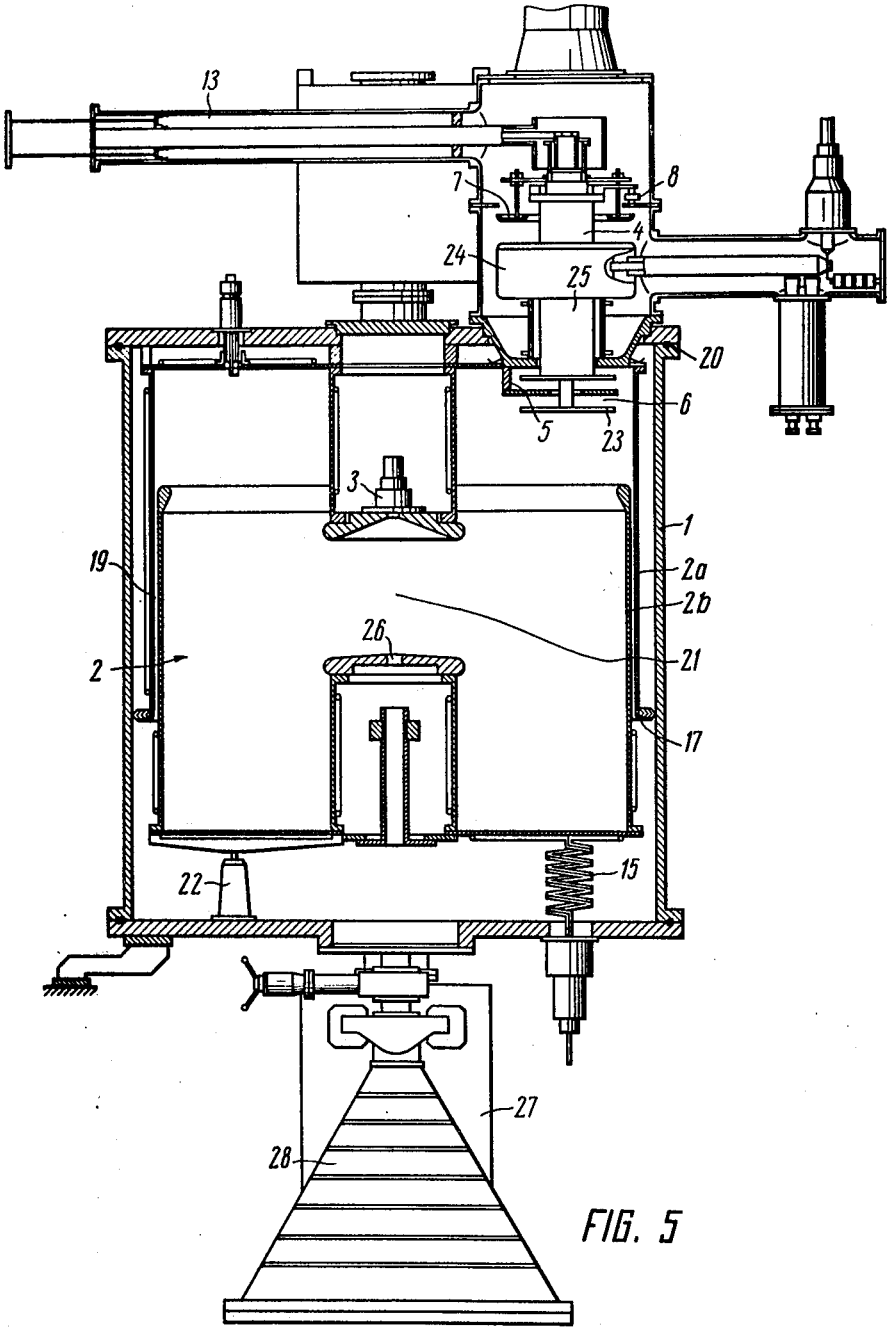
FIG. 5 shows a diagrammatic view of the same accelerator having the separating capacitor of the coupling loop comprising a system of plates with vacuum gaps therebetween.

FIG. 5 shows a diagrammatic view of the radio-freuqency electron accelerator. Supply sources are not shown for convenience.

The toroidal copper accelerating resonator 2 which at the same time is a part of the anode circuit of the self-excited oscillator is made in the form of a pair of cup-shaped members 2*a* and 2*b* insulated from each other which are partially received in each other to define a gap 19 therebetween to define the capacitor 14 (FIG. 2) for closing the path of high-frequency current of the resonator 2. The resonator 2 is accommodated in the metal vacuum casing 1. A seal 20 of the metal vacuum casing 1 is made of indium. To reduce losses of radio-frequency power which may leak through the gap 19 between the members 2*a* and 2*b* of the resonator 2, the edge 17 of the outer member 2*a* of the resonator 2 is electrically coupled (e.g. by welding) to the vacuum casing 1 along the entire perimeter. The natural frequency of the cavity between the inner member 2*b* of the resonator 2 and vacuum casing 1 is selected to be sufficiently different from the natural frequency of the accelerating resonator 2. Negative voltage is applied to the inner member 26 of the resonator 2 via the high-frequency choke 15 for suppression of high-frequency resonance discharge and evacuation of ions from accelerating gap 21. The inner member 2*b* of the resonator, which is insulated from the outer member thereof, is mounted on three support insulators 22. The oscillator tube 4 is arranged directly on the outer end face of the resonator 2. The anode of the oscillator tube 4 is connected to the resonator 2 by means of an induction coupling loop 5 without using an intermediate feeder. The separating capacitor 6 comprises a system of plates 23 having vacuum gaps therebetween.

The anode circuit of the oscillator which consists of distributed reactance parameters of the anode having a copper screen 24, anode water tank 25, resistance of the coupling loop 5 and resistance of the resonator in the circuit of the coupling loop 5 represents a two-circuit oscillation system in which one of the frequencies is close to the natural resonance frequency of the high-Q accelerating resonator, and it is this frequency that defines the oscillator frequency.

The oscillator has an internal feedback formed by the additional structural capacitor 7 inserted between the cathode and anode of the tube 4 and comprising a disc placed above the anode of the tube 4 and separated therefrom by an air gap. As shown in FIG. 5, the anode of the tube 4 is protected by a screen 24. Fine tuning of the feedback ratio and its phase is effected by means of the cathode loop 13.

The electron gun 3 is mounted directly on the internal projection of the member 2*a* of the resonator 2 axially thereof. The construction of the resonator 2 may also be used for operation with an external injector of charged particles. For emergence of the beam of accelerated electrons from the resonator 2, a central orifice 26 is made in the wall of the internal projection of the inner member 2*b* of the resonator 2. The vacuum casing 1 is evacuated by means of cold-cathode ion pumps 27. An outlet device 28 for scanning and emitting the beam into atmosphere is secured to the bottom wall on the lower side of the vacuum casing 1 (FIG. 5).

The radio-frequency electron accelerator functions in the following manner.

After evacuation of the vacuum casing 1 (FIGS. 1,5), the supply source of the electron gun 3 and the heating supply source 10 of the oscillator tube 4 are energized. Upon energization of the supply source 11 of the anode, the oscillator is self-excited at the frequency which is close to the frequency of the high-Q accelerating resonator 2, and high voltage appears at the accelerating gap thereof, the value of the voltage depending on the area of the coupling loop 5 and supply source voltage. Electrons are drawn from the cathode of the electron gun 3 by the positive half-wave of the high-frequency voltage and accelerated in the accelerating gap 21 of the resonator 2. By varying the area of the coupling loop 5, the system may be matched with various accelerating voltages at a given output level of the electron beam; varying the length of the cathode loop 13 provides for accurate tuning of the feedback ratio and phase.

In order to improve stability of operation of the accelerator, prolong the life of the electron gun 3 (FIGS. 2,5) and suppress high-frequency resonance discharge in the resonator 2, negative d.c. voltage of several kV is applied to the lower inner member 2*b* of the resonator 2 from the source 16, the ions formed in the accelerating gap 21 being evacuated therefrom via the orifice 26.

In order to reduce losses of radio-frequency power which may leak through the gap 19 (FIGS. 3,5) between the members 2a and 2b of the resonator 2, the edge 17 of the outer member 2a of the resonator 2 is electrically coupled to the metal vacuum casing 1 along the entire perimeter, and the natural frequency of the cavity between the inner member 2b of the resonator 2 and the vacuum casing 1 is selected to be sufficiently different from that of the accelerating resonator. Coupling of the outer member 2a of the resonator 2 to the vacuum casing 1 protects the cavity between the vacuum casing 1 and this member against penetration of radio-frequency power.

As distinguished from the above-described embodiments of the accelerator, which may operate in both continuous and pulsed mode, the embodiment of the accelerator shown in FIG. 4 is designed for operation in the pulsed mode only. It is noted that the time for gaining steady oscillation amplitude not only depends on the quality of the accelerating resonator 2 and feedback ratio, but is determined to a large extent by the initial amplitude of oscillations, that is the initial starting conditions and availability of auxiliary excitation of the accelerating resonator 2 by the moment of arrival of next pulse. Therefore, in order to reduce the time of growth of oscillations in the accelerating resonator 2, which is equivalent to improvement of efficiency due to an increase in useful pulse length, a positive d.c. voltage is applied to the anode of the oscillator tube 4 via a pulse transformer 12 from an independent source 18 so that auxiliary excitation is provided for the resonator 2 during intervals between pulses.

The radio-frequency electron accelerator made in accordance with the construction shown in FIG. 5 has the following specifications. Working frequency 110 MHz. Shunting resistance of the resonator 2–4 MOhm. Auxiliary excitation voltage 800 V. Voltage applied to the inner member 2b of the resonator 2–6 kV. Voltage at the accelerating gap 21 — which is 10 cm long — 1.5 MV, with the anode supply voltage equal to 23 kV. Pulse length 400 Ms, recurrence frequency 50 Hz.

The oscillator was built around a pulse-type oscillator triode 4 having a pulse output up to 2 MW. Average loss of power in the resonator 2 was from 4 to 5 kW, and average output of the electron beam was 20 kW which provided an electron efficiency of 80%. During tests, the accelerator worked to the above specifications continuously for 500 hours without disconnections. Maximum voltage obtained at the accelerating gap was 2 MV. A modulator of any appropriate type may be used for supplying the oscillator tube 4, provided it has sufficient output. With a voltage of up to 350 kV at the resonator 2, the accelerator may work in the continuous mode. The accelerator according to the invention is reliable in operation and simple in manufacture.

What is claimed is:

1. A radio-frequency electron accelerator comprising: a metal vacuum casing; an accelerating resonator accommodated in said casing and forming a first resonant circuit; an electron gun arranged on a central inner projection of a toroidal surface of the said resonator and feeding an electron beam into an accelerating cavity axially along said resonator; a radio-frequency power source for producing an accelerating voltage, comprising a self-excited oscillator including a single oscillator tube mounted directly on said resonator and having an anode water tank associated therewith; a coupling loop accommodated in the cavity of said resonator and directly connected to the anode of said oscillator tube; a separating capacitor in the coupling loop, said coupling loop being accommodated in the cavity of said resonator and connected to the anode water tank of the said oscillator tube and forming together with the output capacitance of the tube, the inductance of the tube lead and the anode water tank, a second resonant circuit of a two resonant circuit oscillation system in the anode circuit of said oscillator tube for the transmission of energy to the accelerating beam of electrons and tuned to a resonant frequency equal to or close to the resonant frequency of said first circuit formed by the said accelerating resonator.

2. A radio-frequency electron accelerator according to claim 1, wherein said accelerating resonator comprises a pair of cup-shaped members, said members being partially received in each other with their open ends and being electrically insulated from each other by providing a gap therebetween which defines a capacitor for closing the path of high-frequency currents; and a d.c. voltage applied to one of said members.

3. A radio-frequency electron accelerator according to claim 2, wherein said d.c. voltage is applied to the inner member of said resonator, and the edge of the outer member of said resonator is electrically coupled to said metal vacuum casing along the entire perimeter thereof.

4. A radio-frequency electron accelerator according to claim 1, wherein the anode of said oscillator tube is connected to an independent positive d.c. voltage source for auxiliary excitation of said accelerating resonator during intervals between pulses when the accelerator functions in the pulsed mode.

5. A radio-frequency electron accelerator according to claim 3, wherein the anode of said oscillator tube is connected to an independent positive d.c. voltage source for auxiliary excitation of said accelerating resonator during intervals between pulses when the accelerator functions in the pulsed mode.

6. A radio-frequency electron accelerator according to claim 1, wherein said separating capacitor of the coupling loop comprises a system of plates having vacuum gaps therebetween.

7. A radio-frequency electron accelerator according to claim 3, wherein said separating capacitor of the coupling loop comprises a system of plates having vacuum gaps therebetween.

8. A radio-frequency electron accelerator according to claim 4, wherein said separating capacitor comprises a system of plates having vacuum gaps therebetween.

* * * * *